United States Patent [19]

Grinshpun et al.

[11] 3,995,468

[45] Dec. 7, 1976

[54] PIPE COLD-ROLLING MILL

[76] Inventors: Mark Izrailevich Grinshpun, ulitsa Pushkina, 4, kv. 21; Vladislav Arkhipovich Mironenko, Juzhny proezd, 1, korpus 3, kv. 73; Nikolai Stepanovich Makarkin, prospekt Lenina, 28, kv. 15, all of Elektrostal Moskovskoi oblasti, U.S.S.R.

[22] Filed: Jan. 7, 1976

[21] Appl. No.: 646,989

[52] U.S. Cl. ..... 72/214; 72/249

[51] Int. Cl.[2] ..... B21B 21/00

[58] Field of Search ..... 72/214, 220, 208, 193, 72/249

[56] References Cited

UNITED STATES PATENTS

| | | | |
|---|---|---|---|
| 3,030,835 | 4/1962 | Krause | 72/214 X |
| 3,211,027 | 10/1965 | Krause | 72/208 |

*Primary Examiner*—Milton S. Mehr

*Attorney, Agent, or Firm*—Lackenbach, Lilling & Siegel

[57] ABSTRACT

The invention relates to rolling production. A pipe cold-rolling mill comprises a stand which has a housing with longitudinal guides rigidly fixed therein. In said guides a carriage is installed on a pair of backup rolls mounted in the housing. Said carriage is connected via a crank gear with a drive of the mill to effect the reciprocating movement of the carriage in said guides in the process of rolling a pipe. Said carriage also carries a pair of working rolls positioned at both sides of the axis of the pipe to be rolled. Said working rolls interact each with one of the two backup rolls and are, together with the latter, spring-actuated one with respect to the other. In such a case, said carriage is rigidly linked with a connecting rod of said crank gear which gear is accomplished so that during the working stroke of the carriage the shafts of all the rolls are positioned in a plane perpendicular to said longitudinal guides, whereas during the idle stroke of said carriage — in a plane inclined to them — the distance between the shafts of the backup rolls is bigger than during the working stroke of the carriage. At the beginning of the idle stroke of the carriage said working rolls are separated under the action of springs, while at the beginning of the working stroke they are brought together until contact is established with the surface of the pipe to be rolled. A mill of such a design is more reliable in operation, has a longer service life and has a greater production capacity than the known mills of the same type.

4 Claims, 6 Drawing Figures

PIPE COLD-ROLLING MILL

Figure 2:
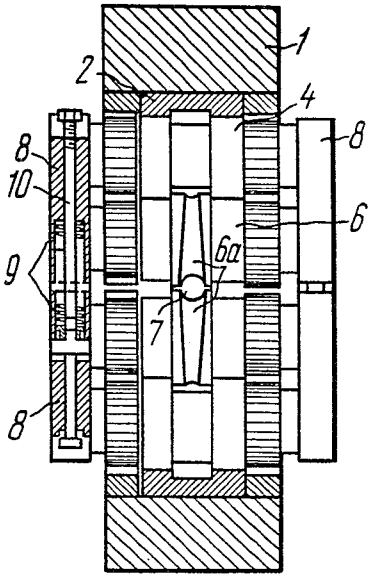

The invention relates to pipe-rolling production and more specifically to pipe cold-rolling mills of the pilger type, wherein rolling of tubular billet is effected in working rolls with a variable section of their groove.

Known in the art are pipe cold-rolling mills (see, for example, U.S. Pat. No. 1263665 of the West Germany, class 7*a* 21/00/). The rolling stand of each of these mills has a housing with longitudinal guides wherein a carriage is mounted on a pair of backup rolls installed in said housing. Said carriage is connected via a crank gear with an independent drive to effect the reciprocating movement of the carriage in said longitudinal guides. Said carriage carries a pair of working rolls positioned at both sides of the axis of a pipe to be rolled, which working rolls interact each with one of the backup rolls and are, together with the latter, spring-actuated one with respect to the other to enable their separation at the beginning of the idle movement of the carriage.

In such mills before the carriage begins to perform its working stroke said working rolls, together with their backup rolls, approach each other, i.e., move in the direction perpendicular to the axis of the pipe to be rolled until their grooves come into contact with the surface of the pipe, whereas before the beginning of the idle stroke all said rolls are separated so that the grooves of said working rolls do not come into contact with the surface of the pipe to be rolled during the idle stroke of the carriage, which factor improves the quality of rolling. Bringing together and separation of rolls in the known mills is effected by bringing together and separating longitudinal guides mounted on a housing with a possibility of being moved laterally by means of a wedge mechanism. The wedges of said mechanism are kinematically linked with a drive for their reciprocating movement along the axis of a pipe and interact with said longitudinal guides.

The main shortcoming of the known pipe cold-rolling mills is that said wedge mechanisms operate under a heavy dynamic regime, which diminishes the speed capacity of mills and causes their premature wear.

The object of the present invention is to produce a pipe cold-rolling mill, wherein the distance between the shafts of working rolls during the forward and reverse movement of the carriage would be changed without changing the distance between longitudinal guides, which would make it possible to raise the production capacity of said mill, as well as to improve its reliability and to prolong its service life as a whole.

These and other objects are attained by a pipe cold-rolling mill the stand of which comprises a housing with longitudinal guides, wherein a carriage is mounted on a pair of backup rolls.

Said carriage is connected via a crank gear with a drive to effect its reciprocating movement in said guides and which carriage carries a pair of working rolls positioned at both sides of the axis of a pipe to be rolled. Said working rolls interact each with one of the backup rolls and are, together with the latter, spring-actuated one with respect to the other for their separation at the beginning of the idle stroke of the carriage and for their subsequent approach — at the beginning of the working stroke of said carriage. According to the invention, said longitudinal guides are rigidly fixed in the housing, and said carriage is rigidly linked with a connecting rod of a crank gear which is accomplished so that in the process of the working stroke of said carriage the shafts of all said rolls are positioned in a plane perpendicular to said longitudinal guides, whereas in the process of the idle stroke said shafts are positioned in a plane inclined to the longitudinal guides, as a result during the idle stroke the distance between the shafts of the backup rolls increases, and the working rolls are separated under the action of springs.

Such a solution enables the distance between the shafts of said working rolls to be changed by varying the angle of inclination of the plane of the shafts of all said rolls to the longitudinal guides via a drive of the carriage, which makes the work of the mill more reliable enabling an improvement in its speed capacity and, hence, its efficiency, as well as a reduction in its weight and the weight of its movable parts.

According to one of the possible embodiments of the invention, the crank gear comprises a balance beam one arm of which is hinged with a connecting rod and the other with an eccentric rigidly fixed on the outlet shaft of a drive; in such a case the middle of said balance beam is hinged with a housing via a turning lever.

It is expedient to apply such a solution in mills for cold rolling of small-diameter pipes (from 16 to 90 mm) which mills comrpise carriages the movable parts thereof have a comparatively low weight.

According to the second embodiment of the invention, a crank of the crank gear is hinged with a connecting rod and rigidly secured to the shaft of a satellite which is mounted with eccentricity in a carrier; said carrier is linked with the outlet shaft of a drive by means of two pairs of toothed wheels; on said outlet shaft is rigidly fixed a sun wheel which is engaged with said satellite.

Such a solution can be applied in mills for rolling large-diameter pipes (from 90 to 450 mm) which mills comprise carriages the movable parts thereof having a heavy weight.

In all embodiments of the invention the carriage can be made as consisting in height of two separate components in each of which are mounted one working roll and its backup roll; at the same time one of these components of the carriage is made integral with a connecting rod, while the other is hinged with said connecting rod, and springs are provided between these components.

Such a solution ensures free access to the backup and working rolls, and to said springs for their inspection, cleaning the replacement.

Figure 1:
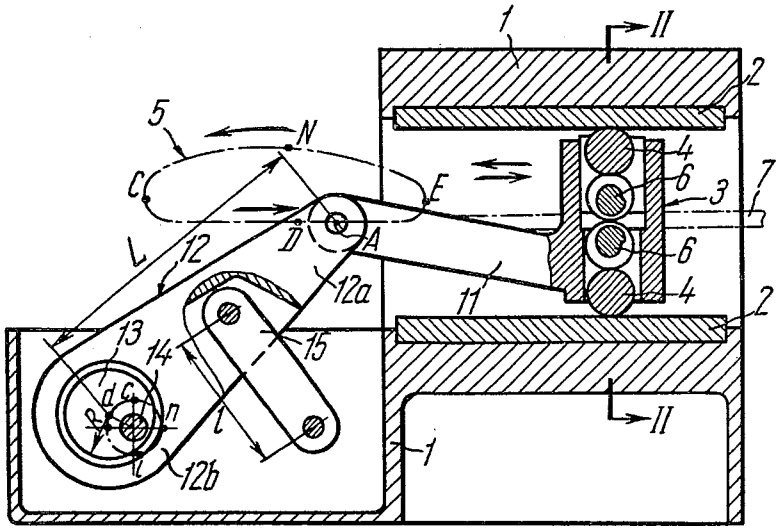
Figure 3:
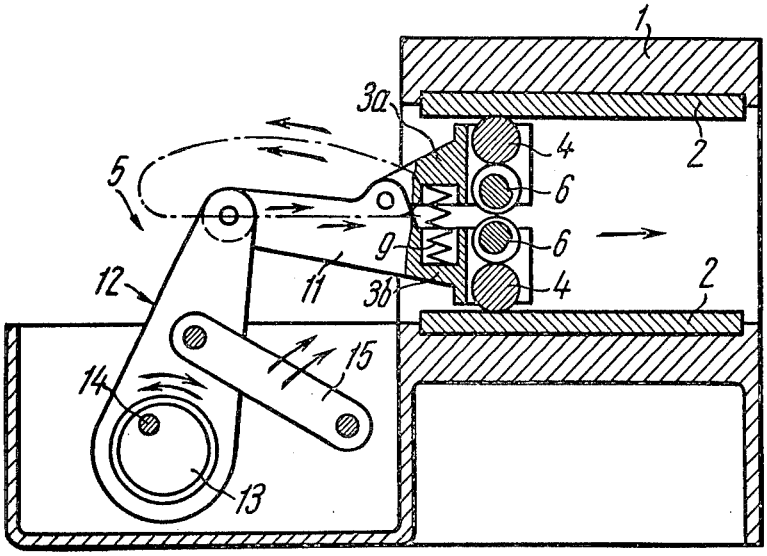
Figure 4:
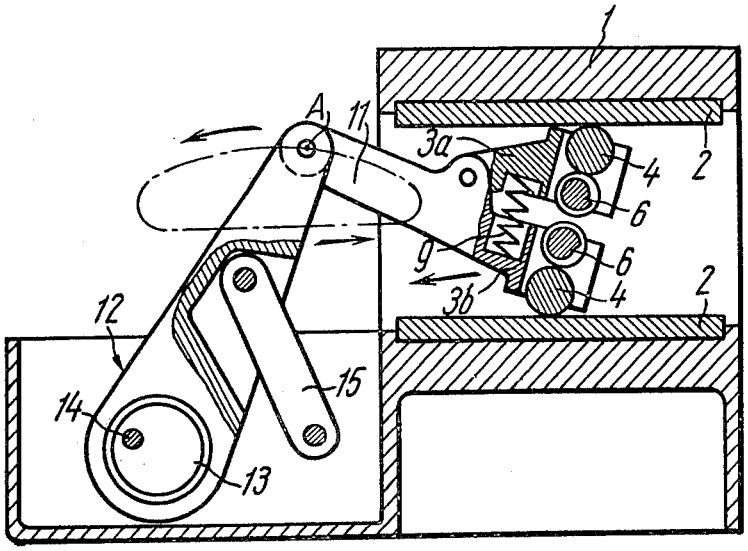
Figure 5:
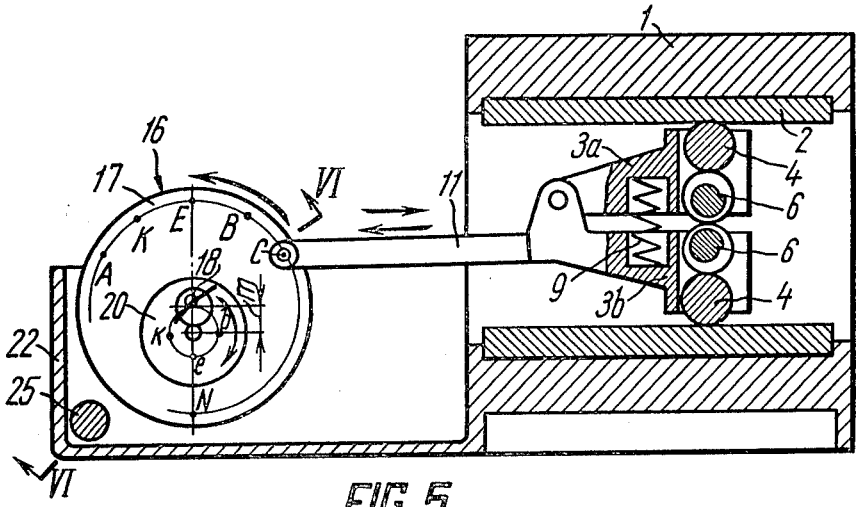
Figure 6:
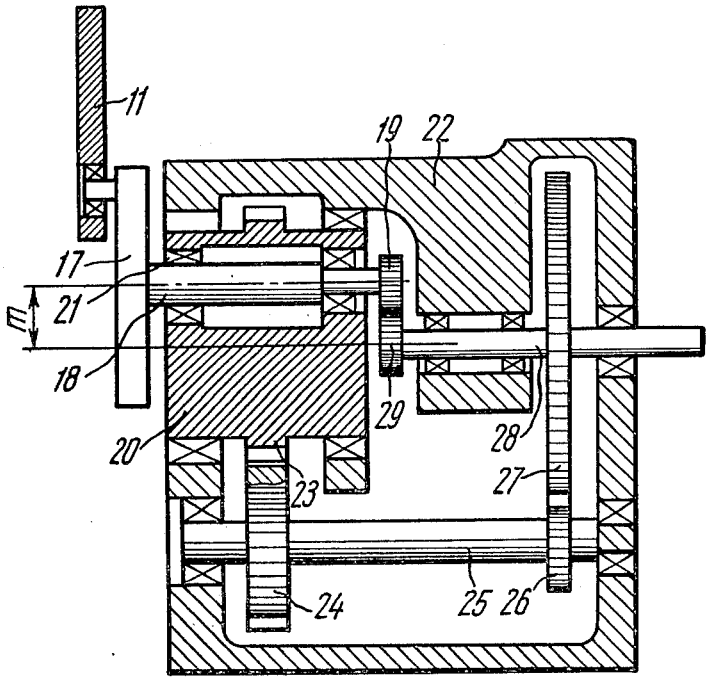

The nature of the invention will be clear from the following detailed description of two possible embodiments thereof, to be had in conjunction with the accompanying drawings, in which:

FIG. 1 schematically shows the pipe cold-rolling mill, according to the invention, the first embodiment of the crank gear (a longitudinal section along the operation line during the working stroke of the carriage); FIG. 2 — section II—II of FIG. 1 (on an enlarged scale);

FIG. 3 — the same mill as in FIG. 1, but with a composite carriage;

FIG. 4 — the same mill as in FIG. 3, during the idle stroke of the carriage;

FIG. 5 — the same mill as in FIG. 1, with the second embodiment of the crank gear;

FIG. 6. — section VI—VI of FIG. 5 (on an enlarged scale).

The pipe cold-rolling mill comprises a stand which has a housing 1 (FIGS. 1–5) with longitudinal guides rigidly fixed therein and made in the form of rest bars 2; the top bar and the lower bar, wherein a carriage 3 is mounted on a pair of backup rolls 4 installed therein.

Said carriage 3 is connected via a crank gear 5 with a drive of the mill to carry out its reciprocating movement along said rest bars 2 in the process of rolling.

In such a case when said carriage 3 moves from the extreme left position (in FIG. 1) to the extreme right position, it performs its working stroke, and when the carriage moves in the reverse direction it performs its idle stroke.

Said carriage 3 carries a pair of working rolls 6 positioned at both sides of a pipe 7 to be rolled between the backup rolls 4 with which said working rolls 6 interact.

The shafts of each working roll 6 and of its backup roll 4 are mounted in a bearing support 8 (FIG. 2); said support is installed in vertical guides provided in the side walls of the carriage 3.

The top working roll 6 together with the top backup roll 4 are spring-actuated relative to the lower working roll 6 and its backup roll 4 via cylindrical compression springs 9 secured to strainers 10 in coaxial vertical sockets provided in the bearing supports 8 of the rolls 4 and 6.

A groove 6a with a variable cross section over the circle of the roll 6 wherein said pipe 7 is rolled is provided on the surface of each working roll 6 along the operation line (along the axis of the pipe to be rolled 7).

According to the invention, said carriage 3 (FIG. 1) is rigidly linked with a connecting rod 11 of the crank gear 5 which gear is made so that during the working movement of the carriage 3 the shafts of all said rolls 4 and 6 are positioned in a plane perpendicular to the rest bars 2, as shown in FIGS. 1,3 and 5, whereas during the idle stroke of said carriage 3 said shafts are positioned in a plane inclined to the bars 2, as shown in FIG. 4.

Owing to such a solution the distance between the shafts of the backup rolls 4 during the idle stroke of the carriage 3 is bigger than during its working stroke. This is why at the beginning of the idle stroke of said carriage 3 the working rolls 6 are separated under the action of said springs 9, whereas at the beginning of the working stroke they approach each other under the action of the connecting rod 11 of the crank gear 5 until their grooves **6*a* come into contact with the surface of said pipe 7** to effect its rolling.

According to the first embodiment of the invention, the crank gear 5 (FIGS. 1,3,4) comprises a balance beam 12 which one arm **12*a* is hinged with the free end of the connecting rod 11 made integral with said carriage 3, while the other arm 12*b* of the balance beam 12 is hinged on an eccentric 13 which is rigidly secured to an outlet shaft 14 of the drive. In such a case, the middle of the balance beam 12 is hinged with the end of a turning lever 15 which lever is likewise hinged with said housing 1**.

It is expedient that the length "L" (FIG. 1) of the balance beam 12 (the distance between the axes of hinges on its ends) be equal to a doubled length *l* of said turning lever 15, and the radius "R" of the eccentric 13 be equal to half the length *l* of said lever 15.

With such correlation of the elements of said crank gear 5, the movement of the point "A" (the axis of a hinge linking the ends of said balance beam 12 and the connecting rod 11) will acutally be linear during the working movement of said carriage 3.

In the point where the arm **12*a* of the balance beam 12 is linked with the connecting rod 11 and with the turning lever 15** said arm is made in the form of a fork enveloping said rod and lever. All hinged connections are provided on rolling bearings.

According to the invention, said carriage 3 can be made as consisting in height of two separate components **3*a* (FIGS. 3,4 and 5) and 3*b*; in each of these components one working roll 6 and its backup roll 4 are mounted. At the same time one of the components of said carriage 3 — in our example its lower component 3*b* — is made integral with the connecting rod 11, while the top component 3*a* of said carriage 3 is hinged with its lower component 3*b*; between both said components 3*a* and 3*b* of the carriage 3 are mounted the compression springs 9 intended for separation of said components at the beginning of the idle stroke of the carriage 3, as in FIG. 4**.

Said composite carriage 3 is more handy in operation, as it ensures free access to the grooves **6*a* of said working rolls 6** for their inspection, cleaning and replacement.

The pipe cold-rolling mill with the first embodiment of said crank gear 5, described above, functions as follows.

In the process of the mill's operation the outlet shaft 14 (FIGS. 1,3 and 4) gets rotation from an electric drive (not shown) and which shaft 14 rotates, in its turn, the eccentric 13 fixed thereon.

When the eccentric 13 moves along the arc "cd" (the path of the movement of said eccentric 13 is conventionally shown by a dash-and-dotted line (FIG. 1), the point "A" — the axis of a hinged connection of the balance beam 12 with said connecting rod 11 — will be actually transferred along the direct line "CDE" of the path (as shown in FIG. 1 by said dash-and-dotted line).

In such a case, the carriage 3 (FIG. 1) or its components **3*a* (FIG. 3) and 3*b* will be transferred on the backup rolls 4 along the rest bars 2 from the extreme left position (in FIGS. 1 and 3) to the extreme right position, which corresponds to the working stroke of the carriage 3 or of its components 3*a* and 3*b***.

During the working stroke of said carriage 3 the shafts of the working rolls 6 and of the backup rolls 4 lie in one vertical plane perpendicular to the operation surfaces of the rest bars 2. In such a case, the working rolls 6 contact with the backup rolls 4, whereas their grooves **6*a* contact with the surface of the pipe 7** to be rolled, this resulting in the deformation (rolling) of said pipe.

When the eccentric 13 moves along the arc "enc" (FIG. 1) the point A (FIG. 1) will be transferred along the upper section ENC of its trajectory.

In such a case, the carriage 3 (FIG. 1) or its components **3*a* (FIG. 4) and 3*b* will be transferred from the extreme right position to the extreme left position, which corresponds to the idle stroke of said carriage 3**.

At the beginning of the idle stroke of said carriage 3 the working rolls 6 and the backup rolls 4 are installed so that their shafts are positioned in a plane inclined to the operation surfaces of the rest bars 2. In connection with the fact that the distance between the rest bars 2 along an inclined line is bigger than along a line perpendicular to them — an opening is formed between the working rolls 6 under the action of the springs 9, which opening prevents the grooves **6*a* of said rolls 6 from being contacted with the surface of the pipe 7 to be rolled during the whole idle stroke of said carriage 3. Thus, during the idle stroke of the carriage 3 the pipe 7** is not rolled.

According to the second embodiment of the invention, a crank gear 16 (FIGS. 5 and 6) comprises a crank 17 which is hinged with the connecting rod 11 and rigidly secured to a shaft 18 of a satellite 19.

The shaft 18 with eccentricity *m* is provided in a carrier 20 mounted in bearings 21 of a casing 22.

On its outside surface the carrier 20 has a toothing 23 engaged with a toothed wheel 24; said wheel 24 is rigidly secured to an intermediate shaft 25 mounted parallel to the axis of said carrier 20. The intermediate shaft 25 carries a toothed wheel 26 which is engaged with a toothed wheel 27 secured to an outlet shaft 28 of the drive.

Said shaft 28 is mounted in the casing 22 coaxially with the carrier 20 and carries a sun wheel 29 engaged with the satellite 19.

In the process of operation of the mill the oulet shaft 28 gets rotation from an electric engine (not shown). The gear drives 29-19 and 27-26-24-23 are chosen so that they rotate at constant speed. In such a case, a gear ratio of said gear drives is chosen so that the carrier 20 rotates at a speed which is three times higher than the speed of rotation of the shaft 18 of said satellite 19; the latter speed is corresponding to the number of the strokes of said carriage 3 transferred by the connecting rod 11. (Just as in the first embodiment of the invention, the carriage 3 can be made as consisting in height of the two components 3*a* and 3*b*).

When the point C — the axis of a hinged connection between the crank 17 and the connecting rod 11 — is transferred on the section AKEBC of its path, shown in FIG. 5 by a dash-and-dotted line, the components 3*a* and 3*b* of said carriage 3 performs its working stroke, as shown in FIG. 5.

When the above-mentioned point C is transferred on the section ANC of the same path, the carriage 3 performs its reverse stroke.

In connection with the fact that when the point C is transferred on the section CBE and subsequently on the section EKA with the shaft 18 of said satellite 19 being transferred, correspondingly, on the sections CBE and EKA of its path, and the path of movement of the end of the connecting rod 11 (of the point C) is actually close to a direct line then during the whole forward movement of the carriage 3 the shafts of all said rolls 4 and 6 are positioned in one plane perpendicular to the working surface of the rest bars 2.

When the point C of the crank 17 moves on the section ANC, the shafts of all said rolls 4 and 6 are positioned in a plane inclined to the rest bars 2, and an opening is formed between the grooves 6*a* of the working rolls 6, which opening prevents the pipe from being rolled during the reverse stroke of the carriage 3.

Then the mill's operation cycle described above is repeated.

What we claim is:

1. A pipe cold-rolling mill the rolling stand of which comprises: a housing; longitudinal guides rigidly mounted in said housing; a carriage mounted in said longitudinal guides; a pair of backup rolls installed in said carriage with the help of which the carriage is transferred in said longitudinal guides; a pair of working rolls mounted in said carriage at both sides of the axis of a pipe to be rolled and which working rolls interact each with one of the two backup rolls and are, together with the latter, spring-actuated one with respect to the other; said stand also comprises a crank gear which connects said carriage with a drive of the mill to effect the reciprocating movement of said carriage in said longitudinal guides in the process of rolling; said crank gear is rigidly linked by its connecting rod with said carriage and is made so that during a working stroke of the carriage the shafts of said pairs of the back-up and working rolls are positioned in a plane perpendicular to said longitudinal guides, whereas during an idle stroke of said carriage said shafts are positioned in an inclined plane, as a result of which during the idle stroke of said carriage the distance between the shafts of the backup rolls is bigger than during the working stroke; at the beginning of the idle stroke of said carriage the working rolls are separated under the action of springs, while at the beginning of the working stroke of the carriage they are brought together.

2. A pipe cold-rolling mill of claim 1, wherein the crank gear has a balance beam one arm of which is hinged with said connecting rod, while the other with an eccentric secured to an outlet shaft of the drive; in such a case, the middle of said balance beam is hinged with said housing via a turning lever.

3. A pipe cold-rolling mill of claim 1, wherein a crank of the crank gear is hinged with the connecting rod and rigidly secured to the shaft of a satellite which satellite with eccentricity is mounted in a carrier; via two pairs of toothed wheels said carrier is connected with said outlet shaft of the drive to which shaft a sun wheel engaged with said satellite is rigidly secured.

4. A pipe cold-rolling mill of claim 1, wherein the carriage is made as consisting in height of two separate components; in each of these components are mounted one working roll and its backup roll; at the same time one of said components of the carriage is made integral with said connecting rod, whereas the other is hinged with it, and springs are provided between these components.

* * * * *